United States Patent [19]

Conklin

[11] Patent Number: 4,726,098

[45] Date of Patent: Feb. 23, 1988

[54] COMBINATION VORTEX ACTION PROCESSING AND MELT SIZING OF SPUN YARN

[75] Inventor: Delano M. Conklin, Burlington, N.C.

[73] Assignee: Burlington Industries, Inc., Greensboro, N.C.

[21] Appl. No.: 923,024

[22] Filed: Oct. 24, 1986

[51] Int. Cl.[4] ..... D02J 3/18; B65H 71/00

[52] U.S. Cl. ..... 28/166; 28/179; 28/219; 57/295; 57/333

[58] Field of Search ..... 57/295, 333, 224; 28/178, 179, 219, 166; 139/435

[56] References Cited

U.S. PATENT DOCUMENTS

| | | | |
|---|---|---|---|
| 2,334,420 | 11/1943 | Lang | 57/295 |
| 2,932,076 | 4/1960 | Cocker, III | 28/179 X |
| 3,279,164 | 10/1966 | Breen et al. | 57/333 X |
| 3,621,646 | 11/1971 | Bobkowicz et al. | 57/224 |
| 3,977,854 | 8/1976 | Fulmer et al. . | |
| 3,990,132 | 11/1976 | Illman et al. . | |
| 4,015,317 | 4/1977 | Johnsen | 139/435 X |
| 4,088,468 | 5/1978 | Roberson . | |
| 4,115,088 | 9/1978 | Walker . | |
| 4,540,610 | 9/1985 | Conklin et al. | 28/178 X |

*Primary Examiner*—Robert R. Mackey

*Attorney, Agent, or Firm*—Nixon & Vanderhye

[57] ABSTRACT

Spun yarns are subjected to the vortex action of an impinging, circularly rotating fluid to lay down extending staple fibers against the yarn body while causing the yarn path to balloon and are then contacted with a melt size presented on a slower moving grooved melt size applicator. As a result of the ballooned yarn path, the yarn wipes melt size from the sides and bottom of the groove, giving the yarn a smooth, substantially continuous coating on its outside surface. Spun yarns so treated may be successfully woven as filling yarn on a water jet loom and knit as the warp yarn or as laid-in yarns on a knitting machine without excessive lint accumulation.

13 Claims, 5 Drawing Figures

FIG. 1
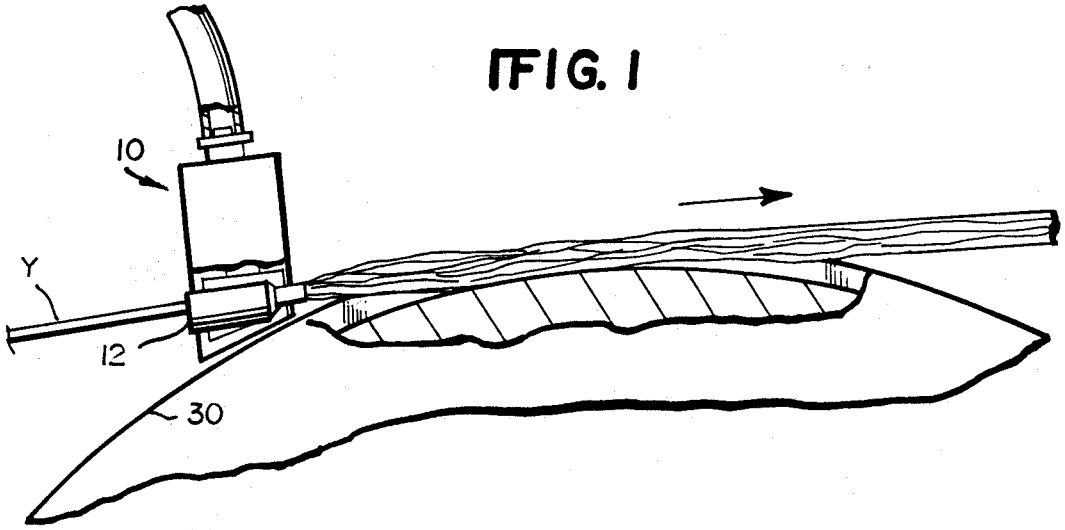
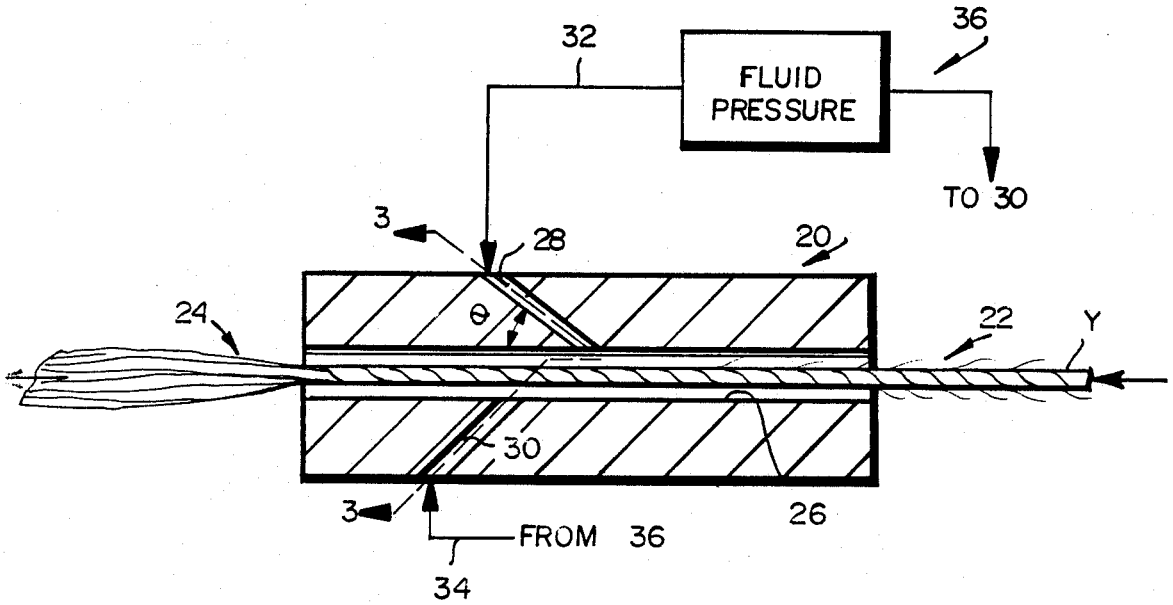
FIG. 2

FIG. 3
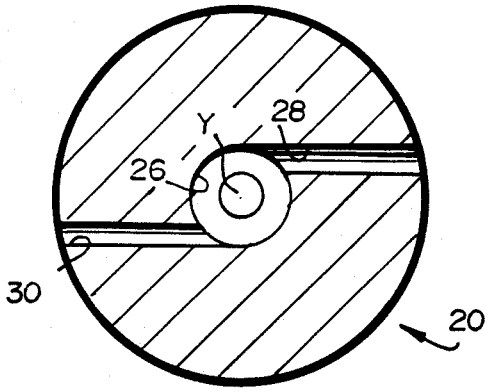
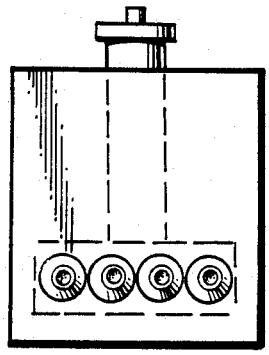
FIG. 4
FIG. 5
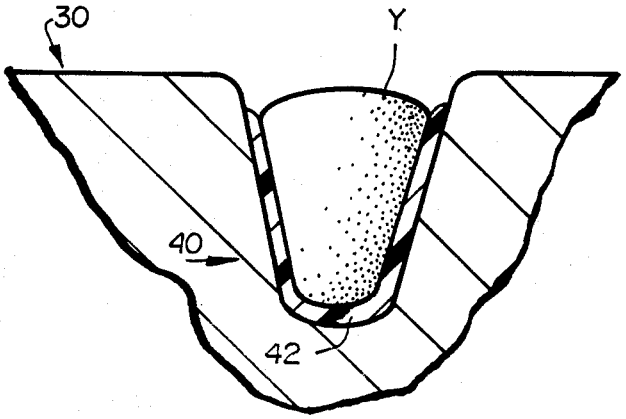

COMBINATION VORTEX ACTION PROCESSING AND MELT SIZING OF SPUN YARN

BACKGROUND OF THE INVENTION

This application relates to the treatment of spun yarns, and more specifically to the preparation of the yarn by securing the otherwise extending fiber ends to the yarn body, melt sizing the yarn and preparing it for weaving or knitting operations on equipment that was previously only used to weave or knit continuous filament yarns. Spun yarns so processed may now be woven or knit efficiently on equipment previously restricted to continuous filament yarns.

Continuous filament styles are subject to seasonal styling fluctuations, and because of these unavoidable seasonal styling limitations, looms are idle at various times. Conventional wisdom indicates that spun yarn cannot be successfully woven or knot on equipment intended for continuous filament yarns because the amount of shedding eventually requires the equipment to be shut down and cleaned. Conventional spun yarns woven on a water jet loom cause lint to be collected by the water on various loom parts, and when the quantity of accumulated lint becomes large enough, it is transferred to the fabric. When this occurs, it is necessary to stop the loom and remove lint deposits at a frequency that becomes economically unfeasible. Similar conditions apply in warp knit operations. Not only does lint shedding cause fabric defects, but protruding fibers cause adjacent ends to roll which may result in dropped stitches. Thus, these undesirable conditions limit warp knit spun yarn styling.

It is commmercially feasible to warp knit staple yarns spun from cotton or polyester/cotton, but at normal knitting speeds the knitted fabrics that are produced contain an intolerable number of defects. For example, fabrics warp knitted from 50/1 Supima cotton yarns at normal speeds were found to contain an average of 4.9 defects (including dropped stitches caused by lint, stop marks, etc.) per hundred square yards. In addition, stop marks often affect the fabric appearance on the side of the machine opposite the side on which the defect occurred. Reduction of the number of fabric defects to a number like 3 to 4 per hundred square yards would greatly improve the market for warp knit spun fabrics. Such results are now made possible by the process of this invention.

This invention provides a spun yarn whose lint is prevented or inhibited from shedding on the fabric production equipment, and thus quality and production problems are avoided because of the absence or substantial absence of spun yarn lint. As a consequence, the number of times the equipment needs to be stopped for cleaning is reduced to an acceptable, economic level and the fabric formation equipment used for various stylings becomes more flexible. In addition, the process provides a means for efficiently weaving staple yarns as the filling on a water-jet loom, with a low amount of shedding and lint accumulation. Staple yarns, such as cotton, can now be run efficiently on warp knitting machines with only a low amount of shedding and greatly reduced defects, resulting in the ability to produce novel, highly attractive new products.

In the process of this invention, spun yarn is passed through a vortex air jet nozzle in which the fiber ends that extend outside the body of the yarn, sometimes referred to as yarn "hairiness", are laid down against the yarn body. The vortex air jet nozzle also serves to orient the spun yarn and configure it just prior to being contacted with hot melt size as presented to the yarn in a grooved applicator roll or other convenient size distributing equipment. The vortex air jet nozzle is used to wrap producting staple fibers around the yarn bundle while at the same time the path of the yarn bundle is "ballooned" in that the yarn assumes a shape resembling that of a standing wave in a violin string after it has been rubbed by the violin bow. The vortex action also causes false twisting of the yarn as the yarn enters the grooved size applicator roll. This ballooning technique has the unexpected benefit of permitting the yarn to wipe not only the bottom of the groove of the melt size applicator roll, but the walls of the groove as well permitting a much lower size add-on as the ballooning action serves to spread the hot melt size more uniformly over the yarn surface. Placement of the vortex air nozzle with respect to its distance from the grooved size applicator roll is adjusted to allow for maximum efficiency and control of size add-on as well as reducing the amount of lint generated during the process to an acceptable, economic level.

Significant is the fact that relatively small amounts of melt size are applied to the yarn, certainly amounts different from hot melt warp sizing of yarns used for weaving. Conventional hot melt warp sizing requires about 5% or more of melt size to be applied to the yarn. In contrast, the two part interactive system of this invention wraps protruding staple yarn fibers around the yarn bundle, configures the yarn bundle for efficient melt size pick-up and immediately "glues" the protruding staple fibers into place by the application of a very modest amount of hot melt size. Not only does the vortex nozzle wrap the fibers around the yarn bundle, it also serves to false twist the yarn, and causes it to balloon, thus positioning it for maximum efficiency and minimum but effective size pick-up as the body of the yarn enters the grooved roll. This permits quantitatively lower size pick-up, calculated as add-on or additional weight to the weight of the yarn, and serves to spread the hot melt size over the surface of the yarn more uniformly while minimizing discharge of extraneous yarn lint products.

A vortex action fluid nozzle suited for the process of this invention is described in detail in co-pending, commonly-assigned U.S. application Ser. No. 719,129 filed Apr. 2, 1985, the disclosure of which is hereby incorporated by reference. The grooved melt size applicator roll is of a type illustrated in commonly-assigned U.S. Pat. No. 3,990,132, the disclosure of which is also incorporated by reference.

It is the primary object of the present invention to provide a procedure and equipment for reducing yarn hairiness and applying an optimum, but reduced amount of melt size in a simple, effective manner. Additional objects of the invention include the use of spun yarns so treated for weaving fabrics on a water jet loom and for knitting fabrics on warp knitting machines. In warp knitting, the hot-melt-sized yarns of this invention can serve either as the warp yarns themselves, or as laid-in yarns in either the wrap or filling direction. In particular, the invention permits the textile manufacturer to construct fabrics from sources other than continuous filament yarns, for instance cotton, wool or other nonsynthetic fibers. These and other objects of the invention will become clear from this specification, an inspection of the detailed description of the drawings, and from the appended claims.

BRIEF DESCRIPTION OF THE DRAWINGS

FIG. 1 is a side schematic cross-sectional view, partially broken away, of an exemplary vortex air jet and cylindrical melt size applicator for conducting the process of the present invention;

FIG. 2 is a side schematic cross-sectional view of an exemplary vortex air jet treatment apparatus for use in the present invention;

FIG. 3 is an end cross-sectional view of the body member portion of FIG. 2 taken along lines 3—3 of FIG. 2;

FIG. 4 is a perspective end view, showing a plurality of vortex air jet treatment nozzles arranged side-by-side in a manifold; and FIG. 5 is an enlarged partial cross-sectional view of a yarn contacting the melt size-coated walls of the groove of the size applicator roll.

This application describes a method of applying melted polymeric sizing to a spun yarn by passing a spun yarn having protruding staple fibers, in substantially dry condition, in a substantially linear path while directing several streams of pressurized fluid such as air or steam towards the passing yarn to establish a vortex action on the yarn which twists and wraps the protruding staple fibers against the body of the yarn while causing the yarn to assume a ballooned path, and immediately thereafter directing the spun yarn, while in its ballooned path, into a melt size-containing open groove of a melt size applicator. The outside surface of the yarn contacts the melt size within the open groove, wiping the melt size from the walls and bottom of the groove and spreading the melt size over the contact portions of the yarn. This forms a substantially uniform melt size outer coating on the yarn surface and adheres the surface fibers of the spun yarn contacted with the melt size in place. The melt size then solidifies on the outer surface of the thus-treated spun yarn.

The yarns may be composed of cotton, spun polyester or a blend of spun polyester and cotton fibers, or the yarn may be a two-component yarn in a sheath/core arrangement with the sheath of one fiber type and the core of a different fiber type, such as a yarn with a polyester core and a cotton sheath.

Yarns so treated may be used to warp knit fabrics in which the spun yarns are laid-in warp yarns, laid in filling yarns or both, as well as fabrics woven on a water jet loom. Warp knit fabrics have a very small number of defects, calculated on the basis of 100 square yards; the defects are less than three and preferably less than 1.5 on the average.

DETAILED DESCRIPTION OF THE DRAWINGS

The exemplary embodiment of the apparatus illustrated in FIG. 1 includes a vortex jet manifold 10 which, in this particular view, shows a single nozzle 12 (illustrated in further detail in FIGS. 2 and 3) through which a yarn Y passes, the incoming yarn having several protruding fibers or "hairs" on its surface and inside the nozzle 12, a vortex of swirling fluid contacts these fibers and lays them down against the body of the yarn while at the same time the moving fluid, typically air, going through nozzle 12 balloons the yarn path, thus serving to both false twist the yarn and configure it in the optimum form for efficient contact with the immediately-adjacent melt size presented by the grooved size applicator roll 30. The distance between the output of the nozzle 12 and yarn's contact with the groove of the grooved size applicator roll 30 is subject to adjustment, but is maintained relatively short, as explained in more detail below. After the yarn in its ballooned state has had ample contact with the groove of the size applicator roll and the predetermined quantity of melt size is relatively uniformly and thinly spread over the outside of the yarn on the grooved applicator roll 30, the sized yarn is then taken away to be wound into packages or other configurations (not shown).

In FIG. 2, a tubular body member 20 is shown through which yarn Y having undesired hairiness is passed. The incoming yarn portion 22 is the portion requiring treatment with the apparatus 12, and, as schematically illustrated in FIG. 2, has excessive hairiness. The outgoing yarn section 24 depicts the yarn after treatment with the apparatus 10, and has the protruding hairs thereof twisting and laid down so that the treated yarn section 24 has significantly less hairiness than the untreated section 22. The body of the yarn, having its excess hairs properly placed, has its path ballooned into a wider cross-sectional area as it emerges from the central passageway 26 of the vortex air treatment apparatus 20.

The body of the tubular body member 20, typically of brass, hard plastic, ceramic, stainless steel, or the like, has a substantially central through-extending, generally linear passageway 16 formed in it. The passageway 16 is generally circular in cross-section, as can be seen in FIG. 3, and extends from a first end of the body 20 (the end in which the relatively hairy section 22 of yarn Y enters) to a second end (from which the ballooned, reduced-hairiness section 24 exits). The passageway 26 has a substantially constant diameter from the inlet to the outlet in the embodiment illustrated; however, this may be varied as shown in Ser. No. 719,129.

Several bores—in the embodiment illustrated in FIGS. 2 and 3, two bores 28, 30'—are provided in the body 20. The bores 28, 30' extend from the external periphery of the body to the central passageway 26, intersecting the central passageway 26 as seen in both FIGS. 2 and 3, and are tangentially disposed with respect to the central passageway 26, as shown in FIG. 3. This configuration creates a vortex action causing the protruding hairs of the yarn Y to be twisted and laid down on the yarn Y, significantly reducing the hairiness, as comparison of sections 22 and 24 of the yarn Y will make clear. The particular diameter of the passageways 28, 30', the number, the particular angle $\theta$ at which they are disposed, etc., may be varied depending upon the particular circumstances.

In the embodiment illustrated in FIGS. 2 and 3, the bores 28 and 30' each make a positive angle $\theta$ with respect to the yarn Y and the passageway 26. The angle $\theta$ is significantly greater than 0°, and less than 90°, and preferably is about 80°–88° (an approximately 45° angle between each bore and the yarn or passageway being illustrated in FIG. 2).

Fluid under pressure, such as air or steam, is applied to the bores 28, 30' through the conduits 32, 34, respectively, the conduits being connected to a source of fluid under pressure 36. In the embodiment of FIGS. 2 and 3, the points of intersection of the bores 28, 30' with the passageway are spaced from each other along the length of the passageway 26.

As shown in FIGS. 2 and 3, bores 28 and 30′ create a counterclockwise vortex. It is apparent that a clockwise vortex jet can be produced by changing the tangential positions of bores 28 and 30′. Generally a Z-twist yarn should be subjected to a Z-vortex jet of the invention, and an S-twist yarn to an S-vortex jet, for most effective laydown of the protruding hairs.

As the yarn Y issues from the discharge end of channel 26, a portion of the fluid introduced into the channel 26 and not exiting through the incoming end passes through the exit portion of channel 26 and serves to bulk or false twist the yarn and to prevent fumes from the molten size from clogging channel 26. The amount of false twisting will depend, in part, on the amount of tension applied to the yarn as well as the amount of fluid pressure, typically air pressure, applied in the vortex jet treatment device. As an example, for the embodiment illustrated in FIGS. 2 and 3, air pressure is typically in the range of between about 12 and 30 psi. If the air pressure drops considerably below 12 psi, two detrimental events occur. First, the yarn ballooning action becomes erratic and is greatly reduced and, as a consequence, the surface wiping action of the yarn in the groove is reduced which, in turn, reduces the spreading of the size over the outer surface of the yarn. Second, the protruding fibers are bound less securely, and this will result in increased shedding. On the other hand, if the pressure exceeds say 30 psi, again for this specific embodiment, the yarn will simply become untwisted and pull apart due to the false twisting effect. The tendency to pull apart is mitigated by increasing the tension on the yarn; however, if tension is increased beyond the yarn's safe running conditions, the yarn will break. The amount of tension a yarn can safely handle is related to its fiber identity and diameter. As a general guideline, good results may be expected with the hot melt size applicator illustrated provided that a tension no more than 20% of the yarn's minimum breaking strength is applied, this measured after the hot melt applicator, but before take-up of the melt sized yarn.

The size of the yarn path balloon is also controlled by the distance between the discharge portion of the nozzle 12 and the point at which it contacts the base and two side walls of the groove of the size applicator roll. Preferably, the exit nozzle is placed as close to the grooved applicator roll as possible. This is because the yarn is difficult to guide into its corresponding groove if the exit point from the nozzle is too far from the groove. Further, physical limitations and positioning of the equipment can also limit the distance between the exit point of the nozzle and the groove of the size applicator roll. Again, specific to the embodiment shown in FIGS. 1–3, an optimal range for the distance between the discharge portion of the vortex jet air treatment nozzle 12 and the groove of the sizing roll is from about 0.75 inches to about 1.25 inches. If a distance greater than 1.25 inches is used in the embodiment illustrated, the yarn will start to form a double-balloon, that is its path will expand, converge and then expand again before entering the groove of the size applicator roll, which serves to increase running tension. Equipment placement will be largely dictated by the type and configuration of the individual components, the nature of the yarn being melt sized, as well as other processing conditions. Variables will be adjusted and optimized in accordance with experience of the operator.

As shown in enlarged detail in FIG. 5, melt size is applied to the yarn by a cylindrical applicator surface 30 provided with a metered supply (not shown) of molten size 42 that resides primarily in the groove 40 and moves with the rotation of the cylinder to a region where the yarn is briefly submerged in the associated groove, and wetted with the melt as it is being squeezed through the melt before leaving the rotating cylinder to a take-up reel (not shown). The ballooning action resulting from the vortex jet apparatus expands the cross-section of the path of the yarn Y entraining the individual fibers in air and allowing the yarn to wipe the opposing sides as well as the bottom of the groove 42.

Although melt sizing a single yarn is depicted in FIGS. 1 and 5 for purposes of illustration, a multiplicity of parallel yarns comprising a warp may be treated at the same time, first through an array of vortex action fluid nozzles then sized on a multi-grooved cylindrical size applicator, the incoming yarns passing through a multi-port manifold aligned with the grooves on the cylindrical applicator.

A suitable melt size applicator is illustrated in commonly-assigned U.S. Pat. No. 3,990,132, which describes in some detail the configuration of the grooves and manner in which the melt size may be applied to these grooves. The disclosure of U.S. Pat. No. 3,990,132 is hereby incorporated by reference to the extent necessary to assist in explaining the present invention. Because the melt size quickly returns to a non-tacky, solid state, drying ovens or similar processing equipment is not required.

Textile sizing is a well-known procedure in which a material, usually called "size" or "sizing", most commonly in the form of an aqueous solution, is applied to individual textile warp yarn threads or strands to protect them from the physical abuse of the weaving operation. This type of sizing is not to be confused with the operation of applying sizing to a finished textile fabric to stiffen it, or to add weight, or for other reasons of modifying the fabric's finished character. In the case of individual warp threads which are treated with a size application before weaving to make them more resistant to the abrasive action of the loom, further purposes for sizing are to reduce the hairiness of the strands and thereby to eliminate their tendency to cling together because of such hairiness, to protect and reinforce the yarn prior to weaving, to reduce shedding of fibers from the strands because of the abrasive wear on the yarn by mechanical devices during processing, and to reduce the rolling that entangles together adjacent unsized yarns. All of these factors can act to cause thread breakage, machine stoppage, and defects in the finished goods. The size may be of a type that is conveniently later removed by washing or scouring.

The process of the present invention is concerned with a very specific type of sizing; it is hot melt sizing in which a polymeric composition, normally solid at room temperatures, is heated to render it molten and it is this molten size that is applied to the yarn in the form of a quick-setting, high-molecular-weight, film-forming melt size composition.

Hot melt sizes are a specific class of polymeric compositions characterized by their film-forming and quick-setting properties. Hot melt size compositions which may be employed according to the present invention are a specific class of thermoplastic materials which when heated to a predetermined temperatures becme slightly viscous and less solid to form a melt. Hot melts are used predominantly with textile materials as an adhesive or as a textile sizing. Typically, such compositions have a melt viscosity less than about 2000 cps at 300° F. Examples include blends of ethylene/vinyl ester copolymers, petroleum wax and a thermoplastic resin or blends of copolymers of ethylene with acrylic or methacrylic acid. These blends have low melt viscosities, are easily applied to textile yarns and set up rapidly at ambient temperatures to yield non-tacky coatings on the fibers and fiber bundles. Hot melt adhesive compositions are described in U.S. Pat. Nos. 4,136,069; 4,401,782; 4,082,883; 4,253,840; and 4,576,665, the disclosures of which are incorporated herein by reference. The size composition may be provided with a pigment or other coloring means to impart a tint or color to the sized yarn. As most size compositions are removed by aqueous scouring, the tint also will be removed.

The configuration of the groove or grooves in the cylinder is dependent upon several factors. Groove widths substantially equal to the diameter of the yarn being sized are generally preferred. Wider grooves however, are also satisfactory, though perhaps not quite so effective in laying the fibers and fiber ends protruding from the body of the yarn. Groove widths of 10–15 mils, with depths of 50 mils, have been used with notable success with a variety of yarns.

The shape of the grooves may be varied to advantage from substantially parallel to slightly tapered walls, all preferably with rounded bottoms. Grooves 50 mils deep, with polished walls tapering from about 15 mils apart at the surface of the cylinder to 10 mils at their rounded bottoms, have proved particularly effective and adaptable to a variety of yarn types and sizes, and these are preferred. The tapering appears to assist two ways: promoting flow of size toward the bottom of the groove, and flexing and rolling the yarn as it is squeezed into and out of the gently constricting walls as it enters and leaves the groove.

Although the essentially open-shell structure for providing the grooved cylindrical surface is preferred for its versatility and relative ease of construction, other cylindrical grooved structures and means of constructing them will be readily apparent to those skilled in this technology. Suitable grooved applicators made by other means are considered to fall within the scope of this invention.

The rate of melting of size is controlled by a combination of factors including the temperature and speed of rotation of the applicator cylinder, melting point of the size, and speed of the moving yarn, among others.

The invention will be further illustrated by the following non-limiting examples.

EXAMPLES

A 100% polyester 27/1 staple yarn was sized by first passing it through the vortex jet nozzle as depicted in FIGS. 1 and 2 supplied at an air pressure of 18 psi. Distance between the nozzle discharge and the size applicator roll was ⅞ inch, and the yarn was transmitted through the vortex jet nozzle at a speed of 400 yards per minute. The size application temperature was 375° F. and HM48M Hot Melt Size, made by Burlington Industries Chemical Division was used as the size. This product contained 48% of ethylene/acrylic acid, 48% of hydrogenated tallow, and 4% of dodecanedioic acid. Total size add-on ranging from 1.8 to 2% by weight was noted.

In another experiment, a 100% polyester 12/1 staple yarn was sized through the same vortex air nozzle supplied with air at a pressure of 18 psi. Distance between the discharge portion of the nozzle and the size applicator roll was as reported above, but the yarn speed was 600 yards per minute. The yarn was over-kissed while back winding with a 12.5% solution of a surfactant (dioctyl ester of sodium sulfosuccinic acid) to facilitate the weft stop motion on a water jet loom. Total size add-on of 2.5–3% was observed, and the size used was HM48M.

1,000 yards of fabric were woven with the 12/1 100% polyester staple yarn as prepared above used as the filling on a water jet loom while 60 yards of fabric were knit with the 27/1 100% polyester staple yarn prepared as above on a warp knitting machine. In the case of both the warp knitting machine and water jet loom, only a small amount of shedding was observed, and the amount was so small as not to be considered troublesome.

100% polyester yarns treated in accordance with the invention to reduce fiber hairiness and prevent shedding were successfully knitted on tricot knitting machines. Previous attempts to tricot knit similar polyester yarns, but not treated in accordance with the present invention, have been unsuccessful because spun yarns roll, and shed fibers that cause yarn breaks, machine stops and fabric defects. In an initial trial, two knitted fabrics representing a broad range of fabric styles were successfully knitted without experiencing problems previously associated with conventional spun yarns. Following knitting, the fabrics were desized, dyed, framed and napped to make velours.

The process of the invention allows the textile manufacturer several variations not previously available. For example, virtually all warp knit fabrics currently available are made of continuous filament yarns, and thus are virtually 100% synthetic. The process of the present invention allows the manufacturer to incorporate significant quantities of spun yarns, and the resulting products may be labelled as cotton when the spun yarn used contains the requisite quantity of cotton. Use of spun polyester as a substitute for certain triacetate velour and fleece fabrics is now possible, the spun polyester being an attractive and fully acceptable substitute for other fibers. Particularly attractive yarns for the purposes of this invention are the sheath/core cotton/polyester yarns in which a cotton outer cover or jacket is applied over a polyester core. When treated in accordance with the invention and when knit or woven in the desired form, the resulting products exhibit the virtue of cotton's comfort against the skin while also having the advantages of polyester's shape retention and, in the case of warp knits, a structure which in certain garment constructions is useful to aid molding and shape retention.

It will thus be seen that according to the present invention means have been provided for conforming and melt sizing spun yarn in a simple and effective manner. While the invention has been shown and described in what is presently conceived to be the most practical and preferred embodiment thereof, it will be apparent to those of ordinary skill in the art that many modifications may be made within the scope of the invention, which scope is to be afforded the broadest interpretation of the appended claims so as to encompass all equivalent structures and methods.

What I claim is:

1. A method of applying melted polymeric sizing to a spun yarn, comprising the steps of:

(1) passing a spun yarn having protruding staple fibers, in substantially dry condition, in a substantially linear path and directing a plurality of streams of fluid at a pressure of about 12 to about 30 psi towards the passing yarn to establish a vortex action on the passing yarn to establish a vortex action on the yarn which twists and wraps the protruding staple fibers against the body of the yarn while causing the yarn to assume a ballooned path, and immediately thereafter (2) directing the spun yarn, while in its ballooned path, into a melt size-containing open groove of a melt size applicator, the outside surface of the yarn contacting the melt size within the open groove, wiping the melt size from the wall and bottom of the groove and spreading the melt size over the contact portions forming a substantially uniform melt size outer coating on the yarn surface and adhering the surface fibers of the spun yarn contacted with the melt size in place; and (3) allowing the melt size to solidify on the outer surface of the thus-treated spun yarn.

2. The method of claim 1 in which the melt size is applied in an amount from about 1.75 to about 3.5 percent by weight calculated on the weight of the yarn.

3. The method of claim 1 in which the fluid is air.

4. The method of claim 1 in which the fluid is steam.

5. The method of claim 1 in which the size is removable from the coated spun yarn by scouring in an aqueous surfactant solution.

6. The method of claim 1 in which the spun yarn is passed through a body comprising a substantially cylindrical through-extending linear passageway generally circular in cross-section with an inlet at a first end thereof, and an outlet at a second end thereof and one or more fluid-conducting bores each extending from the outer periphery of the body to the central passageway intersecting and tangentially disposed with respect to the central passageway such that the fluid when introduced under pressure to the bores acts directly upon the yarn passing through the passageway where each bore intersects the passageway to twist and wrap the protruding staple fibers against the body of the yarn.

7. The method of claim 1, in which the yarn is composed of cotton.

8. The method of claim 1, in which the yarn is composed of spun polyester.

9. The method of claim 1, in which the yarn is composed of a blend of spun polyester and cotton fibers.

10. The method of claim 1, in which the yarn is a two-component yarn with a sheath of one type of fibers covering a core of a different fiber type.

11. The method of claim 10, in which the yarn has a polyester core covered by a cotton sheath.

12. A method of applying melt size to the surface of the a spun yarn comprising:

(a) providing a source of hot melt size in a heated, rotating substantially cylindrical roller having a peripheral closed surface and a plurality of parallel grooves therein extending circumferentially about the peripheral closed surface, each groove having a bottom and two side walls adapted to receive the hot melt size and an opening to receive the spun yarn to be sized;

(b) passing a spun yarn having a staple fibers protruding therefrom in a generally linear path through a cylindrical through-extending linear passageway and therein directing one or more fluid streams at a pressure of about 12 to 30 psi towards the passing spun yarn thereby (1) twisting and wrapping the protruding staple fibers against the body of the yarn, and (2) causing the yarn to assume a ballooned path as compared with the yarn path prior to exposure to the vortex action;

(c) directing the yarn, while its path is in the ballooned condition, to the yarn-receiving opening of a melt size-containing groove of the substantially cylindical roller, causing the yarn to contact the melt size-carrying side and bottom walls of the groove thereby coating the outside surface of the yarn with a highly uniform coating of melt size thereby adhering the previously protruding but now twisted and wrapped staple fibers against the body of the yarn; and (d) following the thus-applied melt size to solidify thereby providing a melt size-coated spun yarn substantially completely devoid of protruding staple fibers and adapted for use as filling yarn on a water jet loom, and for knitting.

13. A process of forming a fabric comprising the steps of:

(1) passing a spun yarn having protruding staple fibers, in substantially dry condition, in a substantially linear path and directing a plurality of streams of fluid at a pressure of about 12 to about 30 psi towards the passing yarn to establish a vortex action on the passing yarn to establish a vortex action on the yarn which twists and wraps the protruding staple fibers against the body of the yarn while causing the yarn to assume a ballooned path, and immediately thereafter (2) directing the spun yarn, while in its ballooned path, into a melt size-containing open groove of a melt size applicator, the outside surface of the yarn contacting the melt size within the open groove, wiping the melt size from the wall and bottom of the groove and spreading the melt size over the contact portions forming a substantially uniform melt size outer coating on the yarn surface and adhering the surface fibers of the spun yarn contacted with the melt size in place; and (3) allowing the melt size to solidify on the outer surface of the thus-treated spun yarn; and (4) weaving a fabric on a water jet loom using said spun yarn as filling yarn.

* * * * *

UNITED STATES PATENT AND TRADEMARK OFFICE

CERTIFICATE OF CORRECTION

PATENT NO. : 4,726,098

DATED : February 23, 1988

INVENTOR(S) : Conklin

It is certified that error appears in the above-identified patent and that said Letters Patent is hereby corrected as shown below:

In the drawings, Sheet 1, Fig. 2, the reference numeral "30" should be --30'--, in both instances; and Sheet 2, Fig. 3, the reference numeral "30" should be --30'--. Column 1, line 19, change "knot" to --knit--. Column 2, line 6, change "producting" to --protruding--; line 63, change "wrap" to --warp--. Column 9, lines 5 and 6, delete "to establish a vortex action on the passing yarn". Column 10, line 27, change "following" to --allowing--; lines 38 and 39, delete "to establish a vortex action on the passing yarn".

Signed and Sealed this

Twenty-third Day of August, 1988

*Attest:*

DONALD J. QUIGG

*Attesting Officer*

*Commissioner of Patents and Trademarks*